US008002230B2

(12) United States Patent
Kempte et al.

(10) Patent No.: US 8,002,230 B2
(45) Date of Patent: Aug. 23, 2011

(54) SYSTEM FOR SECURING FURNITURE AND IMPLEMENTS THAT RISK TILTING

(75) Inventors: Andreas Kempte, Zschopau (DE); Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 384 days.

(21) Appl. No.: 12/226,377

(22) PCT Filed: Apr. 3, 2007

(86) PCT No.: PCT/EP2007/053258

§ 371 (c)(1),
(2), (4) Date: Oct. 16, 2008

(87) PCT Pub. No.: WO2007/122080

PCT Pub. Date: Nov. 1, 2007

(65) Prior Publication Data

US 2009/0218471 A1 Sep. 3, 2009

(30) Foreign Application Priority Data

Apr. 20, 2006 (DE) ..... 10 2006 018 421

(51) Int. Cl.
*A47B 97/00* (2006.01)

(52) U.S. Cl. ..... 248/501

(58) Field of Classification Search ..... 248/501, 248/500, 673, 680, 677, 544, 346.03, 346.11; 52/DIG. 11

See application file for complete search history.

(56) References Cited

U.S. PATENT DOCUMENTS

| | | | | |
|---|---|---|---|---|
| 4,191,437 | A | 3/1980 | Funke | |
| 5,954,307 | A | 9/1999 | Williams | |
| 6,024,330 | A * | 2/2000 | Mroz et al. | 248/188.4 |
| 6,533,238 | B2 * | 3/2003 | Barnes et al. | 248/680 |
| 2003/0010886 | A1 | 1/2003 | Barnes et al. | |
| 2005/0127265 | A1 * | 6/2005 | Giovinazzi | 248/673 |

FOREIGN PATENT DOCUMENTS

| | | |
|---|---|---|
| EP | 1 396 693 | 3/2004 |
| SU | 316434 | 10/1971 |
| WO | WO 02/056730 | 7/2002 |

OTHER PUBLICATIONS

International Search Report PCT/EP2007/053258.

* cited by examiner

*Primary Examiner* — Ramon O Ramirez
(74) *Attorney, Agent, or Firm* — James E. Howard; Andre Pallapies

(57) ABSTRACT

A system is provided for securing furniture and implements that risk tilting. The system includes a rail that is mounted on the floor and a roller that is mounted on the piece of furniture or the implement. An extension which engages into the rail so as to form a positive connection thereto is provided on the roller or a roller holder.

7 Claims, 1 Drawing Sheet

SYSTEM FOR SECURING FURNITURE AND IMPLEMENTS THAT RISK TILTING

BACKGROUND OF THE INVENTION

The invention relates to a system for securing furniture and equipment that risk tilting, according to the preamble of claim 1.

Numerous refrigeration appliances are known today, such as refrigerators and freezers in particular, which have a small footprint compared to their height. If the door compartments of such refrigeration appliances are fully loaded, the weight of the door can be up to 100 kg as a result. If such a fully loaded door is opened, it can easily occur that the refrigeration appliance tilts forwards over its front feet. The same effect can occur if, for example, in the case of freezers with fully loaded drawers, several drawers are withdrawn forwards simultaneously. Obviously this risk of tilting affects not only refrigeration appliances but also furniture such as storage cabinets, for example.

In order to prevent tilting of such furniture and equipment, it has already been proposed to fit a square piece of wood to the wall against which the rear panels of such pieces of furniture and equipment are mounted. Since this piece of wood is mounted above the furniture and equipment, it normally cannot be seen by persons located in the room, and therefore does not spoil the overall impression. Of course, such furniture and equipment that risk tilting do not usually stand alone as individual units in a room but belong to an ensemble, for example a row of kitchen units. Their height must therefore be adjustable.

This means that the piece of wood has to be mounted at a distance from the upper edge so that an appropriate height adjustment is still possible. This solution therefore only enables this furniture and equipment to be secured against tipping over, but it cannot prevent tilting.

In another known solution, a rail is mounted on the floor parallel to the wall against which the appliance is be installed. This rail has at each end a U-shaped, upwards extending extension. The appliance is pushed against the wall so that each of the U-shaped extensions engages with a corresponding edge of the housing. But the problem of height adjustment also occurs with this known solution. Sufficient tolerance must remain between the U-shaped extensions and the edges of the housing to allow the necessary height adjustment to be made. Consequently, tipping over of the appliance is indeed prevented in this solution, but tilting cannot be avoided.

BRIEF SUMMARY OF THE INVENTION

The object of the invention is to construct a system for securing furniture and equipment that risk tilting, so that the height of the furniture and equipment can still be adjusted in the necessary manner, and nevertheless, not only tipping over but also tilting is prevented.

The object is achieved according to the invention by a system for securing furniture and equipment that risk tilting. With current customary height adjustments the distance from the support feet or rollers to the underside of the appliance is varied. Since in this case both the rollers and the support feet do not lose their contact with the floor, the appliance or piece of furniture is correspondingly raised or lowered. Due to the inventive securing of a roller or a roller mounting on the floor, this height adjustment can be made as before. The roller or roller mounting can therefore be secured in its position on the floor with very little play. No tolerance for the height adjustment has to be allowed for. Not only is tipping-over but also tilting is likewise prevented in this manner in height-adjustable furniture and equipment. According to the invention, an extension that engages with a rail mounted on the floor is provided on the roller or the roller mounting. This rail is constructed so that when the furniture or equipment is inserted, said rail forms a positive connection with the extension on the roller or the roller mounting.

In an advantageous manner, the rail has a horizontal, U-shaped sliding-block guide. This sliding-block guide can be widened at its front region in the shape of a funnel, so that the likewise horizontal extension of the roller or roller mounting can be easily introduced. Consequently, the sliding-block guide can be designed with just a small tolerance with respect to the size of the extension of the roller or roller mounting. Tilting movements are therefore scarcely possible in furniture and equipment secured in this manner.

In an advantageous manner, a sliding-block guide is provided on both sides of the rail. Corresponding extensions are also fitted on both sides of the roller or roller mounting. Lateral tilting moments can also be reliably controlled in this manner. Equally, as a result, only tensile loads act in an upwards direction on the rail, and inclined loads which could act unfavorably on the attachment of the rail to the floor are scarcely possible.

In a particularly advantageous manner, two rails are provided, each of which secures two rollers or roller mountings. The rollers to be secured are provided in the rear outer region of the floor area. This has a particularly favorable effect if, for example, two pieces of equipment are combined and permanently interconnected at the side walls. Since the outer rollers of this equipment combination are slightly raised by the rails, the middle rollers lose contact with the floor. Consequently, the equipment combination is supported on the floor only via the two outer rollers and unevenness of the floor cannot act unfavorably via the middle roller on the stability of the combination.

BRIEF DESCRIPTION OF THE DRAWINGS

Further details and advantages of the invention are revealed in the subclaims in conjunction with the description of an exemplary embodiment which is explained in detail with the aid of the drawing, where:

DETAILED DESCRIPTION OF THE PRESENT INVENTION

Figure 3:
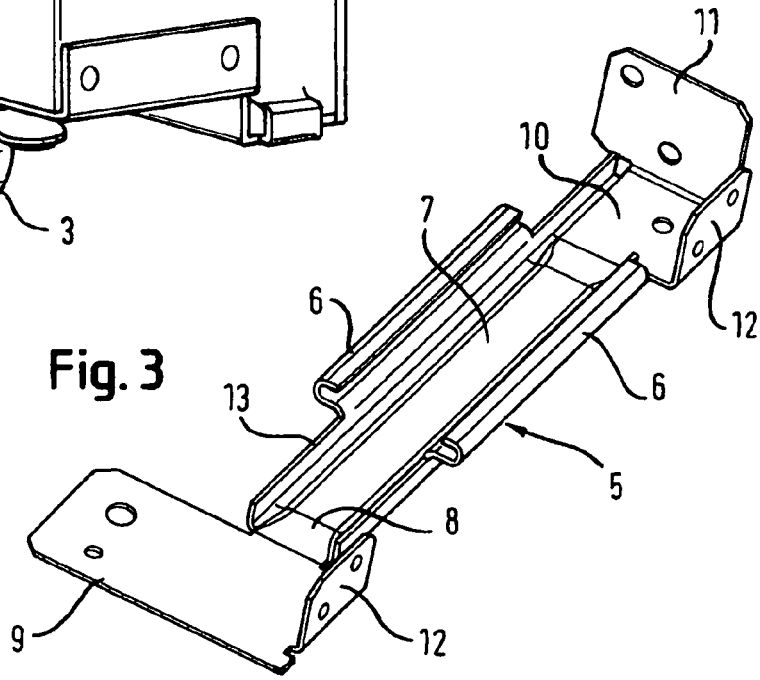
FIG. 3 shows a rail of the inventive anti-tilt system.

The anti-tilt system is formed by a rail 5 and a roller 3 with roller mounting 2. In the exemplary embodiment shown here a refrigeration appliance 1 is fitted with the inventive anti-tilt system. The rail (see FIG. 3) has a baseplate 7 onto which rolls the circumferential surface of the roller 3. The front attachment section 9 and the rear attachment section 10 rest on the floor and are attached thereto.

Furthermore, an attachment section 11 is provided, with which the rail 5 can be fixed to the wall against which the refrigeration appliance 1 is to be mounted via its rear panel. The attachment section 12 can be fixed to the side panel of an adjacent cabinet or to an adjoining unit. The side walls 13 serve to guide the roller 3.

Between the front attachment section 9 and the baseplate 7, a Z-shaped bend forms a ramp 8 which raises the refrigeration appliance 1 when the roller 3 is pushed onto the rail 5. The same Z-shaped bend also joins the rear attachment section 10 to the baseplate 7. In this way the rail 5 is made to contact the floor only with the front attachment section 9 and the rear attachment section 10. Unevenness in the floor can thus be compensated and does not interfere with the adjustment of the refrigeration appliance 1. The U-shaped profiles 6 which act as sliding-block guides for the rib-shaped extensions 4 of the roller mounting 2, are attached to the side walls 13.

Figure 1:
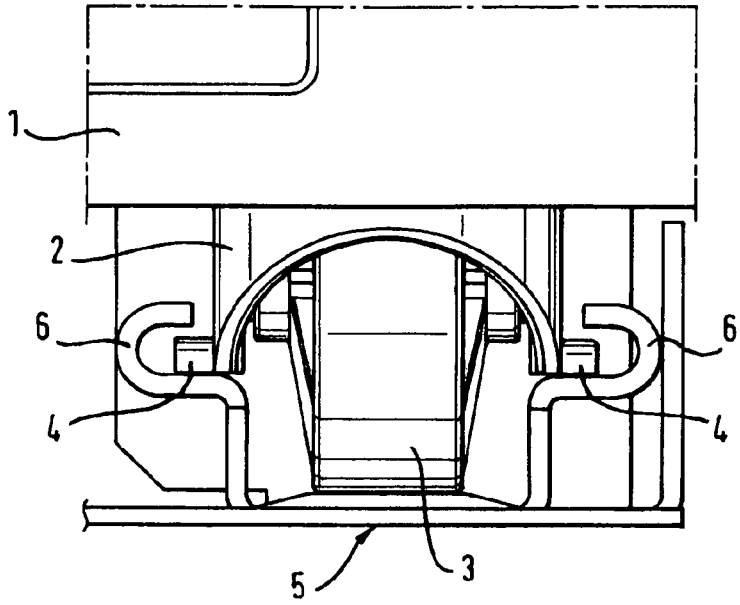
FIG. 1 shows the lower part of a refrigeration appliance with the inventive anti-tilt system
Figure 2:
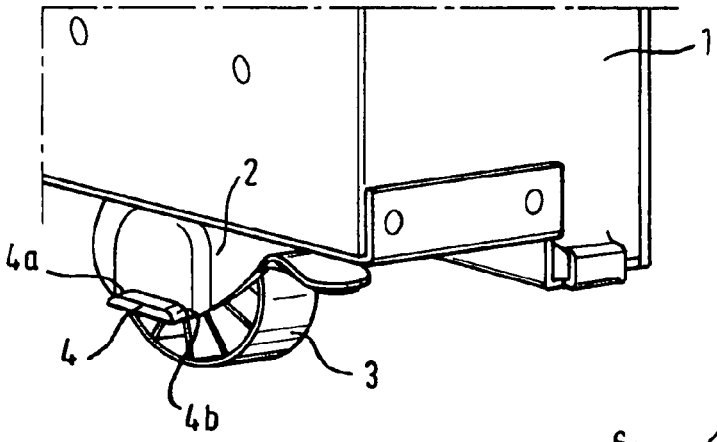
FIG. 2 shows a roller of the inventive anti-tilt system.

As can be seen from FIGS. 1 and 2, a roller mounting 2 is attached to the refrigeration appliance 1. The roller 3 is supported in this roller mounting 2. Furthermore, the rib-shaped extensions 4 are attached to the roller mounting 2. In order to ensure easy insertion of the rib-shaped extensions 4 into the U-shaped profiles 6, one end of each U-shaped profile 6 can be opened out in the form of a funnel.

In the exemplary embodiment shown here, the rib-shaped extensions 4 can instead be made wedge-shaped, so that the extensions can be inserted with sufficient clearance into the U-shape profile 6 via their narrow end 4*b* and then guided through the U-shaped profile 6 via their wide end 4*a* with virtually no play and thus achieve the desired effect.

When the anti-tilt system is installed, two rails 5 are first screwed to the floor and wall, spaced at the distance between the rollers 3. The refrigeration appliance 1 is now positioned so that the rear rollers 3 are located directly in front of the front attachment section 9. The refrigeration appliance 1 is then pushed by means of its rollers 3 onto this front attachment section 9 and on over the ramp 8 onto the baseplate 7 until the rollers 3 are guided by the side walls 13 of the rail 5. On further insertion, the rib-shaped extensions 4 of the roller mounting 2 are inserted via their narrow ends 4*b* into the U-shaped profiles 6. If this movement is continued, the wider end 4*a* of the rib-shaped extensions engages with the U-shaped profiles 6. From this position the extensions 4 are now precisely guided with virtually no play through the U-shaped profiles 6. A tilting movement, for example, when a fully loaded door is opened, is therefore eliminated.

The inventive anti-tilt system has no effect on the height-adjustment capability of the refrigeration appliance. The height is usually set by means of the distance between the roller mounting 2 and the refrigeration appliance 1. The relative position between rail 5 and roller mounting 2 remains unaffected by this.

Likewise, if a combination of two appliances is to be secured, only two rails 5 are installed for the outer rollers. As soon as the outer rollers are pushed over the ramp 8 onto the baseplate 7, the inner rollers, for which no rails have been fitted, lose contact with the floor. This means that in the final position, at its rear side the appliance combination makes contact with the floor only via the two front attachment sections 9 and the two rear attachment sections 10. In this way, unevenness of the floor can have scarcely any negative effect on the adjustment of the refrigeration appliance combination.

LIST OF REFERENCE NUMBERS

1 Refrigeration device
2 Roller mounting
3 Roller
4 Rib-shaped extension
5 Floor rail
6 U-shaped profile as sliding-block guide
7 Rail baseplate
8 Ramp
9 Front attachment section for the floor
10 Rear attachment section for the floor
11 Attachment section for a wall
12 Attachment section for an adjacent piece of furniture or appliance
13 Side wall

The invention claimed is:

1. A system for securing an item relative to a support surface on which the item is supported, including for securing furniture relative to a floor, so as to reduce a risk of tilting of the item, the system comprising:

a rail mountable on the support surface, including mountable on a support surface in the form of a floor;

a roller set up including a roller and a securement arrangement for rotatably securing the roller to the item, the roller being displaceable along the rail to permit adjustment of the position of the item relative to the rail as the item is supported on the rail; and an extension provided on the roller set up, the extension being engagable in a positive connection with the rail such that disengagement of the item from the rail is resisted.

2. The system as claimed in claim 1, wherein the rail has a horizontal U-shaped sliding-block guide.

3. The system as claimed in claim 2, wherein the extension is in the form of a horizontal extension that engages with the sliding-block guide of the rail is fitted to a side of the roller set up.

4. The system as claimed in claim 3, wherein the roller set up and the rail each has a pair of opposed sides and the sliding-block guide and the extension are each provided on both sides of the rail or on both sides of the roller set up, respectively.

5. The system as claimed in claim 4 and further comprising another rail and another roller set up, the rollers of the roller set ups being mountable in a rear outer region of a floor area of the item.

6. A floor rail arrangement comprising:

a rail mountable on a support surface for securing an item relative to the support surface as the item is supported on the support surface so as to reduce a risk of tilting of the item, the rail being cooperatively configured relative to a roller set up including a roller and a securement arrangement for rotatably securing the roller to the item such that the roller is displaceable along the rail to permit adjustment of the position of the item relative to the rail as the item is supported on the rail and the rail being engageable by an extension provided on the roller set up in a positive connection with the rail such that disengagement of the item from the rail is resisted; and a horizontal U-shaped sliding-block guide on a side of the rail.

7. A roller arrangement comprising:

a roller and a securement arrangement for rotatably securing the roller to an item to be supported on a support surface, the roller being displaceable along a rail mounted on the support surface and the rail being cooperatively configured relative to the roller set up such that the roller is displaceable along the rail to permit adjustment of the position of the item relative to the rail as the item is supported on the rail; and an extension provided on the roller set up for engaging the rail in a positive connection such that disengagement of the item from the rail is resisted, the extension being in the form of a horizontal extension on a side of the roller set up.

* * * * *